US005832816A

United States Patent [19]

Seto et al.

[11] Patent Number: 5,832,816

[45] Date of Patent: Nov. 10, 1998

[54] RAM DRIVING DEVICE AND PRESS MACHINE USING SAME

[75] Inventors: Yoshiharu Seto; Shunzo Hirose, both of La Mirada, Calif.

[73] Assignee: Amada Mfg America Inc., La Mirada, Calif.

[21] Appl. No.: 8,840

[22] Filed: Jan. 20, 1998

Related U.S. Application Data

[63] Continuation-in-part of Ser. No. 573,548, Dec. 15, 1995, abandoned.

[51] Int. Cl.[6] ..... B30B 15/14

[52] U.S. Cl. ..... 100/48; 74/665 B; 83/548; 100/98 R; 100/273; 100/282; 100/287; 100/292

[58] Field of Search ..... 100/43, 48, 50, 100/98 R, 273, 280, 282, 287, 292; 72/450, 452.4–452.6; 83/548, 628, 631, 632; 74/25, 49, 490.1, 490.07, 665 B

[56] References Cited

U.S. PATENT DOCUMENTS

| | | | |
|---|---|---|---|
| 29,736 | 8/1860 | Wever . | |
| 2,771,790 | 11/1956 | Munschauer | 100/282 |
| 2,781,015 | 2/1957 | Dehn et al. . | |
| 3,908,437 | 9/1975 | Bachmann . | |
| 4,471,677 | 9/1984 | Lissot et al. . | |
| 4,890,476 | 1/1990 | Takahashi et al. . | |
| 4,923,386 | 5/1990 | Eshima et al. . | |
| 4,929,165 | 5/1990 | Inaba et al. . | |
| 4,990,084 | 2/1991 | Reinhart . | |
| 5,279,197 | 1/1994 | Takeda et al. . | |
| 5,468,194 | 11/1995 | Hayashi | 100/280 |

FOREIGN PATENT DOCUMENTS

| | | |
|---|---|---|
| 41 09 796 | 10/1992 | Germany . |
| 60-49899 | 3/1985 | Japan . |

*Primary Examiner*—Stephen F. Gerrity
*Attorney, Agent, or Firm*—Wigman, Cohen, Lettner & Myers, P.C.

[57] ABSTRACT

A ram driving device for a press machine having: a ram; a horizontal drive axle (33) rotatably provided horizontally in a frame (3) of the press machine; a motion converting mechanism (35, 63, 83) associated with the horizontal drive axle, for converting a rotational motion of the horizontal drive axle into up-and-down motion of the ram (29); and a plurality of servomotors (43, 47) linked with the horizontal drive axle, for rotating the horizontal drive axle in synchronism with each other, to drive the ram up and down. The motion converting mechanism is a connecting rod (35); and a link mechanism (63) driven by a ball screw (61) and a nut member (77); and an eccentric ring cam (33) and a cam follower (91). Since the ram can be driven by a plurality of the servomotors synchronously, the device can generate a large press power of various moving stroke and various moving speed freely, without increasing the maintenance cost thereof.

6 Claims, 6 Drawing Sheets

RAM DRIVING DEVICE AND PRESS MACHINE USING SAME

RELATED APPLICATION

The present application is a continuation-in-part of application Ser. No. 08/573,548, filed Dec. 15, 1995, abandoned, the disclosure of which is incorporated herein by reference.

BACKGROUND OF THE INVENTION

1. Field of the Invention The present invention relates to a ram driving device for moving a ram up and down, which is suitable for a machine such as a press machine, bending machine, etc.

2. Description of the Related Art

Some examples of the conventional ram driving device for moving a ram up and down in a press machine such as a punch press machine will be first described herein below.

As a first ram driving device, there exists such a device that a hydraulic cylinder having a piston linked with a ram is actuated by a hydraulic circuit arrangement.

As a second ram driving device, there exists such a device that a horizontal drive axle is rotatably provided in a frame of a press machine; a rotational motion of the drive axle is converted into the ram up-and-down motion by a motion converting mechanism; and a drive motor is linked with the drive axle via a clutch brake to rotate the drive axle. Here, the motion converting mechanism is usually composed of an eccentric portion attached to the drive axle eccentrically, and a connecting rod one end of which is pivotally linked with a ram and the other end of which is also pivotally linked with the eccentric portion.

As a third ram driving device, there exists such a device that a drive axle and a motion converting mechanism are provided in the same way as with the case of the second example. In this Example, however, the drive axle is directly linked with a servomotor, without use of any clutch brake.

In the above-mentioned conventional ram driving devices, however, there exist the following problems:

In the first example, since the ram is moved up and down by the hydraulic source, the cost required for the maintenance of the hydraulic cylinder and the hydraulic circuit arrangement is relatively high. In the second example, although the maintenance cost is not high, since the moving stroke and the speed of the ram cannot be controlled freely, it is impossible to apply the same ram driving device to various press machines of different moving strokes and speeds. Further, in the third example, since the drive axle is rotated by the servomotor, although the moving stroke and the speed of the ram can be changed freely, since the press power of the ram is relatively small, there exists a problem in that the servomotor cannot be used for a press machine which requires a large press power.

SUMMARY OF THE INVENTION

With these problems in mind, therefore, it is the object of the present invention to provide a ram driving device which can generate a large press power of various moving strokes and various moving speeds freely by a minimum possible modification thereof, without increasing the maintenance cost thereof.

To achieve the above-mentioned object, the present invention provides a ram driving device for a press machine having a ram, comprising: a horizontal drive axle (33) rotatably provided horizontally in a frame (3) of the press machine; a motion converting mechanism (35, 63, 83) associated with said horizontal drive axle, for converting a rotational motion of said horizontal drive axle into up-and-down motion of the ram (29); and a plurality of servomotors (43, 47) linked with said horizontal drive axle, for rotating said horizontal drive axle in synchronism with each other, to drive the ram up and down.

In the first embodiment, said motion converting mechanism (35) comprises: a connecting rod (41) having an eccentric portion (37) coupled with said horizontal drive axle eccentrically; and a link pin (39) for pivotally linking said connecting rod with the ram.

In the second embodiment, said motion converting mechanism (63) comprises: a ball screw member (61) provided as said horizontal drive axle; a nut member (77) in mesh with said ball screw member; a first pivotal link (73) having an upper end pivotally linked with the frame of the press machine and a lower end pivotally linked with said nut member via a pin (69); and a second pivotal link (67) having a lower end pivotally linked with the ram and an upper end pivotally linked with the said first pivotal link (73) via the same pin (69).

In the third embodiment, said motion converting mechanism (83) comprises: an eccentric ring cam (85) formed with an inner and outer circular guide surfaces (89, 87) and fixed to said horizontal drive axle, eccentrically; and a cam follower (91) rotatably attached to an upper end of the ram and rotatably and slidably moved up and down along an annular space formed between the inner and outer circular guide surfaces of said eccentric cam.

Further, a first servomotor is linked with one end of said horizontal drive axle and a second servomotor is linked with the other end of said horizontal drive axle. Further, a plurality of said servomotors are linked with one end of said horizontal drive axle via a gear mechanism (55).

Further, a plurality of said servomotors are linked with both ends of said horizontal drive axle via two gear mechanisms, respectively.

Further, the present invention provides a press machine for pressing work, provided with a ram driving device which comprises:

a horizontal drive axle rotatably provided horizontally in a frame of the press machine;

a motion converting mechanism associated with said horizontal drive axle and said ram, for converting a rotational motion of said horizontal drive axle into up-and-down motion of the ram; and a plurality of servomotors linked with said horizontal drive axle in synchronism with each other, to drive the ram up and down.

In the ram driving device according to the present invention, the movement stroke and the vertical speed of the ram can be controlled freely by changing the rotational speed of a plurality of servomotors in synchronism with each other. In addition, the press power can be increased by use of an appropriate number of servomotors driven in synchronism with each other. As a result, it is possible to adopt the ram driving device according to the present invention to the press machines of various type of different ram movement strokes and ram vertical speeds.

DETAILED DESCRIPTION OF THE EMBODIMENTS

Some embodiments of the present invention will be described herein below with reference to the attached drawings.

Figure 1:
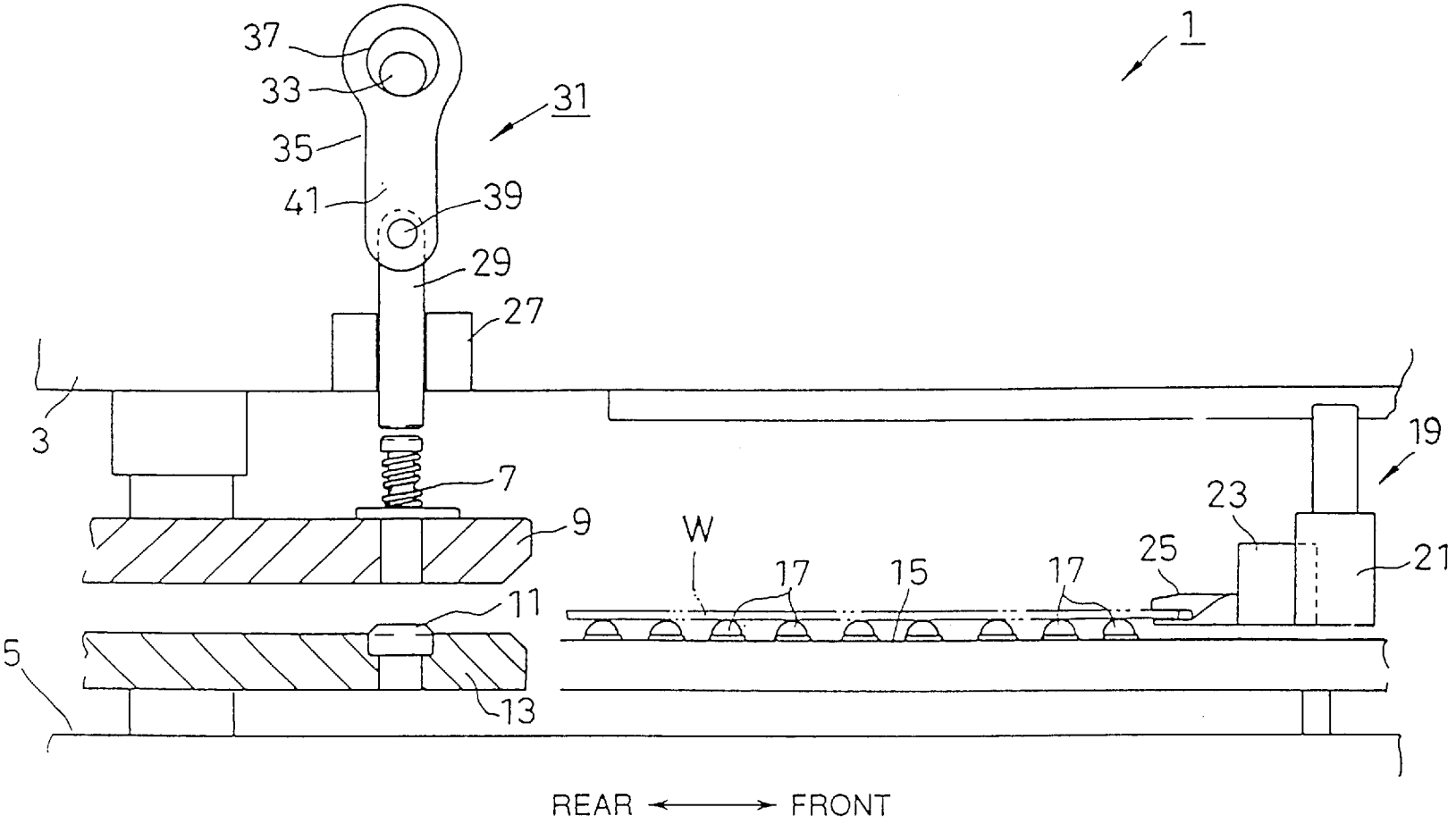
FIG. 1 is an enlarged partial side view showing an essential portion of a first embodiment of the ram driving device for the press machine according to the present invention.

FIG. 1 shows a first embodiment of the ram driving device according to the present invention. In the drawing, a punch press is shown as an example of a press machine. The punch press is provided with an upper frame 3 and a lower frame 5 both being opposed to each other in the vertical direction. To the upper frame 3, an upper turret 9 is rotatably attached. On the upper turret 9, a plurality of punches 7 (only one is shown in FIG. 1) are arranged. On the lower frame 5, a lower turret 13 is also rotatably mounted. On the lower turret 13, a plurality of dies 11 (only one is shown in FIG. 1) are also arranged in such a way that each pair of the punch 7 and the die 11 are mated with each other.

On the front side (the right side in FIG. 1) of the lower turret 13 of the lower frame 5, a table 15 for supporting a plate workpiece W is provided. The table 15 is provided with a number of free bearings 17 for rotatably supporting the workpiece W thereon. Further, on the front side of the upper turret 9 of the upper frame 3, a workpiece position locating device 19 is provided to move the workpiece W in the front-rear direction and in the right and left (the perpendicular direction in FIG. 1). The workpiece locating device 19 includes a first carriage 21 extending in the right and left direction and movable in the front and rear direction of the upper frame 3, a second carriage 23 movable in the right and left direction relative to the first carriage 21, and a clamp device 25 mounted on the second carriage 23.

A ram guide 27 is mounted on the upper frame 3 and over the upper turret 9, along which a ram 29 can be moved up and down to push the punch 7 from the upper side of the punch 7. This ram 29 is moved up and down by a ram driving device 31 (the first embodiment).

Figure 2:
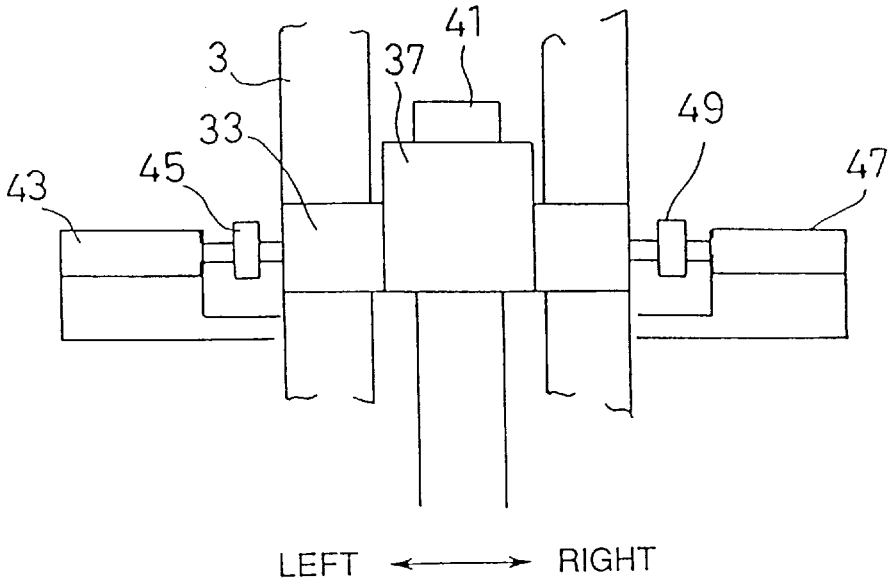
FIG. 2 is a side view showing the link mechanism and the servomotors of the ram driving device shown in FIG. 1.

The ram driving device 31 will be described in detail herein below. On the upper frame 3, a horizontal drive axle 33 is rotatably provided. The rotational motion of this horizontal drive axle 33 is converted into the up-and-down motion of the ram 29 by a motion converting mechanism 35. Here, the motion converting mechanism 35 is composed of a connecting rod 41 having an eccentric portion 37 coupled with the horizontal drive axle 33 eccentrically with respect to the central axis of the drive axle 33, and a link pin 39 for pivotally linking the connecting rod 41 with the ram 29. That is, a lower end of the connecting rod 41 is pivotally linked with the ram 29 via the link pin 39, and an upper end of the connecting rod 41 is pivotally linked with the horizontal drive axle 33 eccentrically. To rotate the horizontal drive axle 33, as shown in FIG. 2, two servomotors 43 and 47 are provided on both sides of the horizontal drive axle 33. That is, a first servomotor 43 is connected to the left end (the left side in FIG. 2) of the horizontal drive axle 33 via a coupler 45 on the left side of the upper frame 3, and a second servomotor 47 is connected to the right end (the right side in FIG. 2) of the horizontal drive axle 33 via another coupler 49 on the right side of the upper frame 3.

Figure 3:
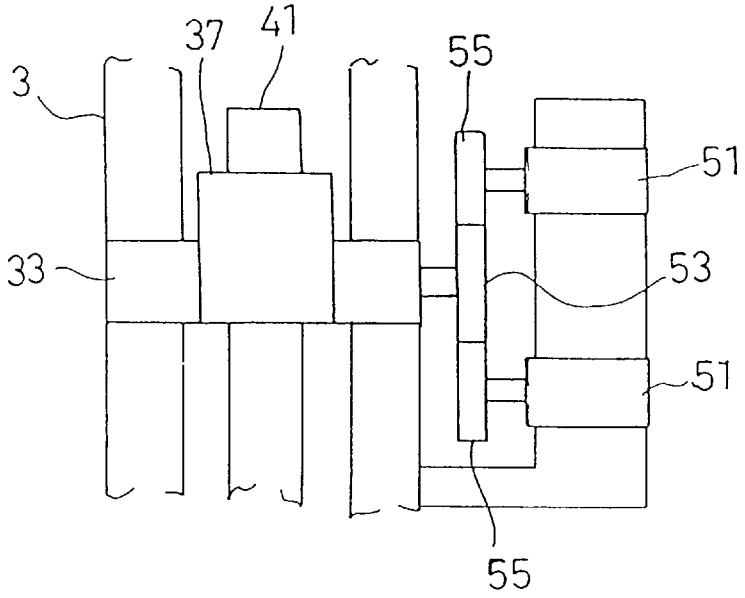
FIG. 3 is a side view showing a modification of the ram driving device shown in FIG. 1.

FIG. 3 shows a modification of the first embodiment shown in FIG. 2. In this modification, instead of the above-mentioned arrangement of the two servomotors 43 and 47, a plurality of servomotors 51 are provided on one (e.g., right) side of the upper frame 3 in linkage with one side of the horizontal drive axle 33. In this modification, a driven gear 53 is formed integral with any of the right and left ends of the horizontal drive axle 33 and in mesh with each drive gear 55 rotated by each output shaft of each servomotor 51.

Figure 4:
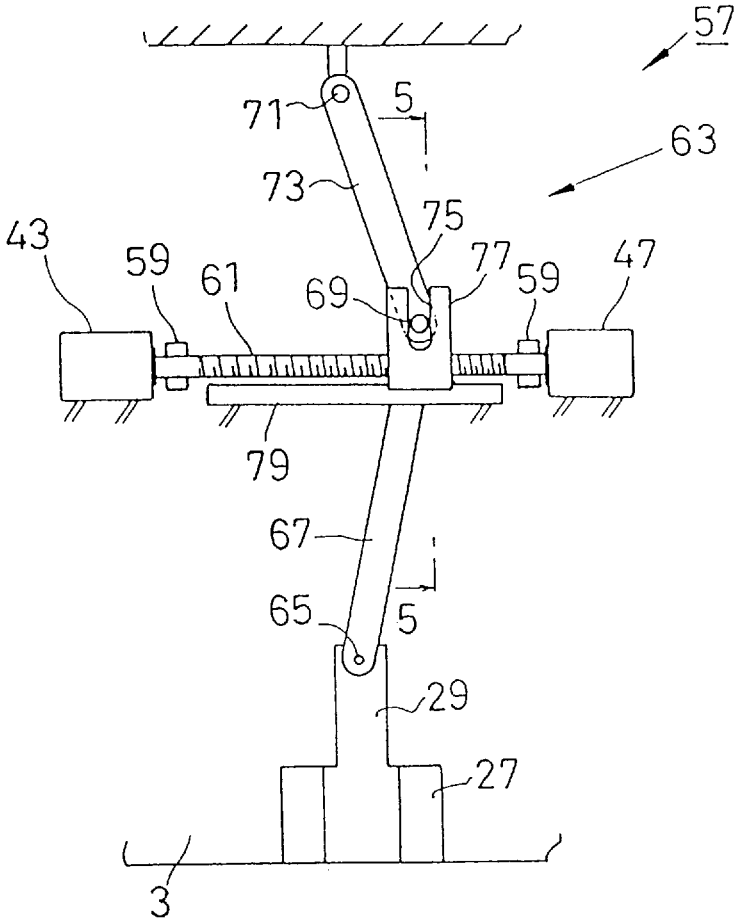
FIG. 4 is a view showing a second embodiment of the ram driving device for the press machine according to the present invention.
Figure 5:
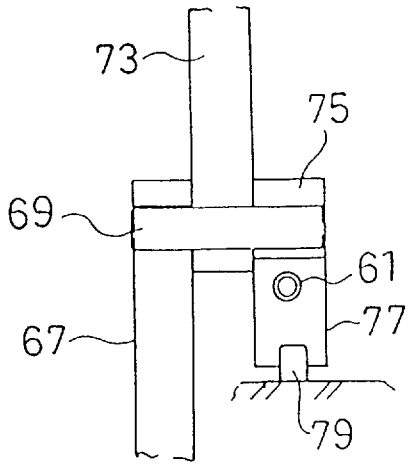
FIG. 5 is a side view showing the same ram driving device when seen from the line 5—5 in FIG. 4.

FIGS. 4 and 5 show a second embodiment of the present invention. In this embodiment, the motion converting mechanism 63 of the ram driving device 57 is composed of a ball screw member 61 rotatably provided on the upper frame 3 via two bearings 59 (as the horizontal drive axle 33); a nut member 77 in mesh with the ball screw member 61; a first (upper) pivotal link 73; and a second (lower) pivotal link 67. The upper end of the first pivotal link 73 is pivotally linked with the upper frame 3 of the press machine via a link pin 71 and the lower end thereof is pivotally linked with a recessed guide hole 75 formed in the nut member 77 via another link pin 69, so as to be movable in the right and left direction in FIG. 4 or 5 when the ball screw member 61 is moved. The upper end of the second pivotal link 67 is pivotally linked with the first pivotal link 73 via the link pin 69 engaged with the recessed guide hole 75 of the nut member 77 and the lower end thereof is pivotally linked with the ram 29 via another link pin 65 also so as to be movable in the right and left direction in FIG. 4 or 5 when the ball screw member 61 is moved. Further, the nut member 77 is supported by a nut guide member 79 mounted on the upper frame 3 so as to be movable in the right and left direction (the right and left direction in FIG. 4 or in the perpendicular direction in FIG. 5).

Figure 6:
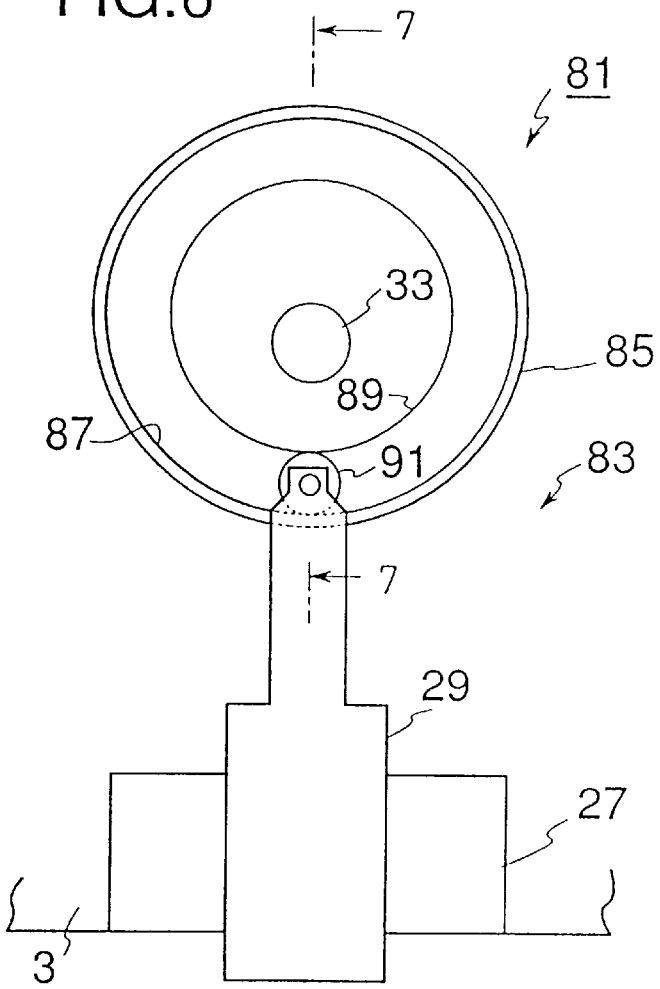
FIG. 6 is a view showing a third embodiment of the ram driving device for the press machine according to the present invention.
Figure 7:
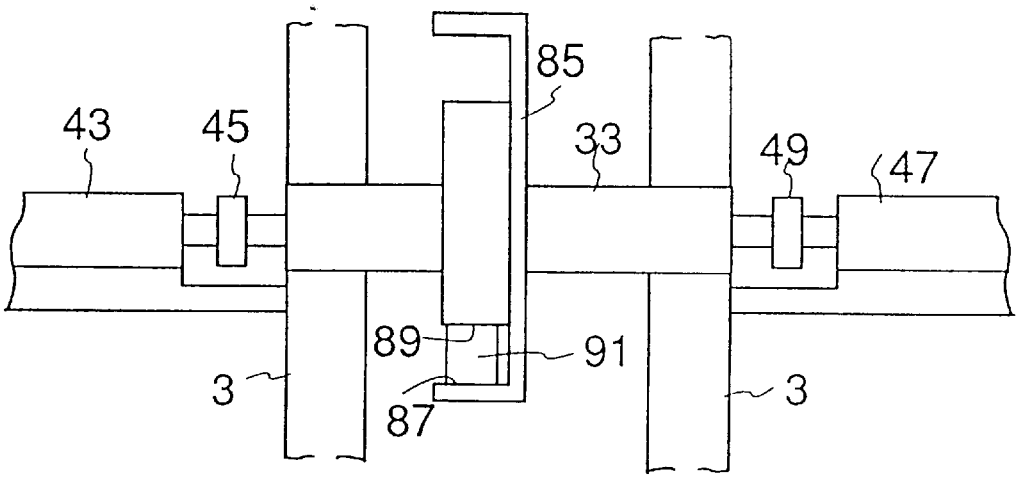
FIG. 7 is a side view showing the same ram driving device when seen from the line 7—7 in FIG. 6.

FIGS. 6 and 7 show a third embodiment of the present invention. In this embodiment, the ram driving device 81 is provided with a motion converting mechanism 83 which comprises an eccentric ring cam 85 formed integral with the horizontal drive axle 33 and formed with inner and outer circular guide surfaces 85 and 87, and a cam follower 91 rotatably attached to the ram 29 and moved up and down along an annular space formed between the two inner and outer circular guide surfaces 87 and 89 of the eccentric ring cam 85.

The operation of the above-mentioned embodiments will be described herein below.

Under the condition that the plate-shaped workpiece W is clamped by the clamping device 25, when the first carriage 21 is moved in the front and rear direction and when the second carriage 23 is moved in the right and left direction, the workpiece W can be located in position between the upper turret 9 and the lower turret 13. Further, a pair of the predetermined punch 7 and the die 11 is indexed at just under the ram 29 by rotating both the upper turret 9 and the lower turret 13 in synchronism with each other.

After the workpiece W has been moved and located in position and further after the punch 7 and die 11 have been indexed in position, the first servomotor 43 and the second servomotor 47 (or a plurality of the servomotors) are driven in synchronism with each other, to rotate the horizontal drive axle 33 in the case of the first and third embodiments and the ball screw member 61 in the case of the second embodiment. Then, the rotational movement of the horizontal drive axle 33 is converted into the up-and-down motion of the ram 29 by the motion converting mechanism 35 (in the first embodiment), 63 (in the second embodiment) and 83 (in the third embodiment). As a result, the ram 29 pushes the indexed punch 7 against the workpiece W from above for press processing.

In the case of the ram driving device 31 of the first embodiment shown in FIG. 1, when the horizontal drive axle 33 is rotated by the two servomotors 43 and 47, since the eccentric portion 37 of the connecting rod 41 can be moved up and down, the rotational motion of the horizontal drive axle 33 is converted into the up-and-down motion of the ram 29 by the motion converting mechanism 35.

In the case of the ram driving device 57 of the second embodiment shown in FIG. 4, when the hall screw member 61 is rotated by the two servomotors 43 and 47, since the nut member 77 is moved in the front and rear direction (along the axial direction of the ball screw member 61), the first upper link 73 and the second lower link 67 are both oscillated in the right and left direction in FIG. 4, so that the rotational motion of the ball screw member 61 is converted into the up-and-down motion of the ram 29 by the motion converting mechanism 63.

In the case of the ram driving device 81 of the third embodiment shown in FIG. 6, when the horizontal drive axle 33 is rotated by the two servomotors 43 and 47, since the eccentric ring cam 85 is rotated, the cam follower 91 is rotatably moved up and down along an annular space formed between the two guide surfaces 87 and 89, so that the rotational motion of the horizontal drive axle 33 is converted into the up-and-down motion of the ram 29 by the motion converting mechanism 83.

In all the above-mentioned embodiments, when the rotational speeds and the angular positions of the output shafts of the first and second servomotors 43 and 47 are changed in synchronism with each other, it is possible to change both the stroke and the vertical speed of the ram 29 at the same time. Further, since the horizontal drive axle 33 is driven by the two servomotors 43 and 47 synchronously, it is possible to obtain any required large press power. Further, when the press power is not sufficient by two servomotors 43 and 47, it is possible to drive the horizontal drive axle 33 by three or more servomotors. In this case, an appropriate motion transmitting means (e.g., gear, pulley, chain, etc.) is interposed between the horizontal drive axle 33 and the drive shafts of a plurality of the servomotors.

Normally, one (referred to as a first motor hereinafter) of a plurality of servomotors 43, 47, 51 is always controlled during the operation of the punch press. The other servomotors 43, 47, 51 (referred to as second servomotors hereinafter) except the first servomotor are not always controlled during the operation of the punch press. In other words, the second servomotors 43, 47, 51 are controlled according to the stages of the operation of the punch press. When the second servomotors 43, 47, 51 are controlled, these second servomotors 43, 47, 51 are just driven by first servomotor through, for example, the drive shaft 33 and do not drive the drive shaft 33.

For understanding of the control of the first servomotor and the second servomotors 43, 47, 51, a second operation of the punch press will be explained hereinafter.

Figure 8:
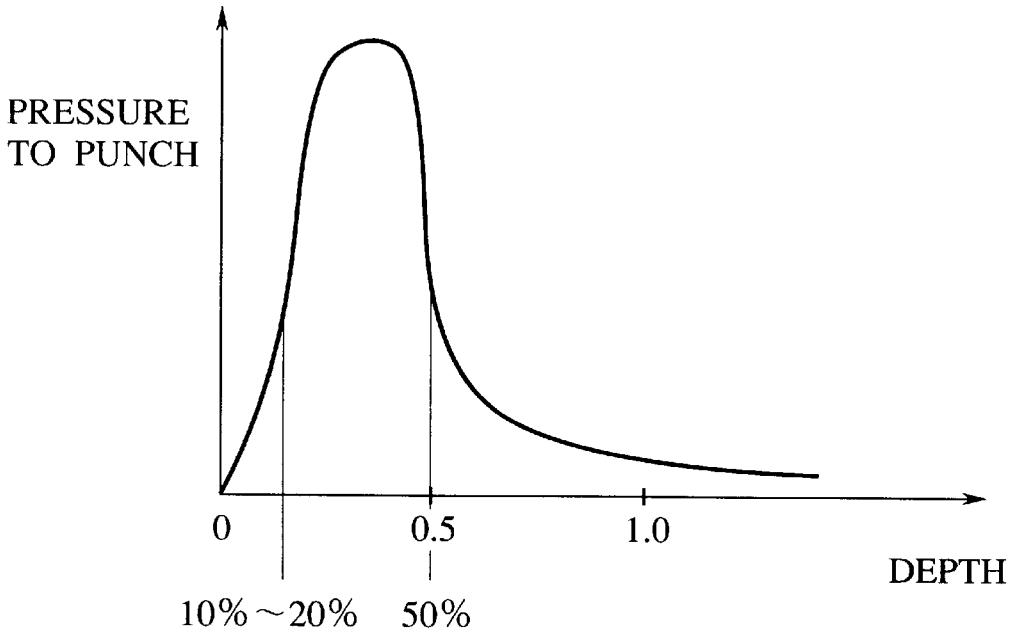
FIG. 8 shows a characteristic curve which indicates a relationship between pressure to the punch and depth of the tip of the punch.
Figure 9:
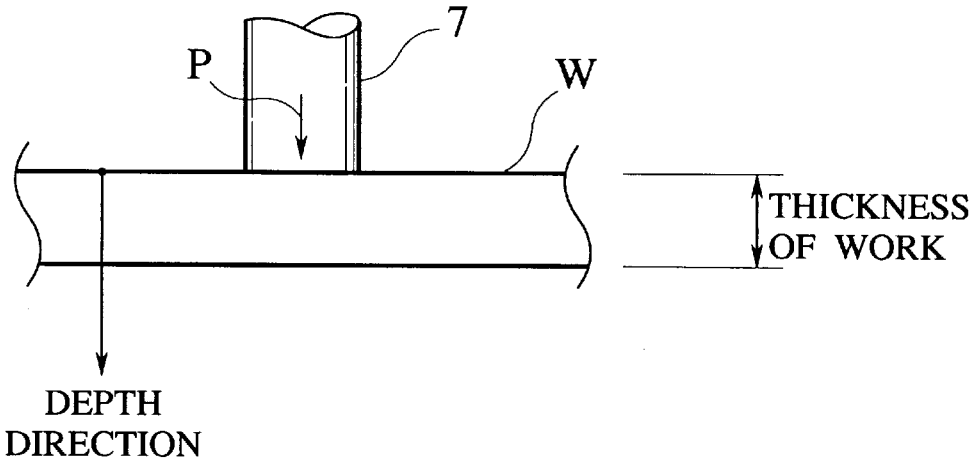
FIG. 9 shows a relationship among the workpiece, punch, thickness of the workpiece and the depth direction.

FIG. 8 shows a characteristic curve which indicates a relationship between pressure to the punch and depth of the tip of the punch. In FIG. 8, the ordinate indicates pressure to punch 7 and the abscissa indicates depth (see FIG. 9) when the punch 7 moves in the depth direction as indicated by arrow P. In the abscissa, number 0 means that the tip of the punch 7 is on the upper surface of the workpiece W, number 0.5 means that the tip of the punch 7 is in the middle of the thickness of the workpiece W, and number 1.0 means the tip of the punch 7 is on the lower surface of the workpiece W.

As well seen from FIG. 8, the pressure to punch within the range of 10%–20% to 50% of the thickness of the workpiece is high, and an application of high pressure is required within this range. Accordingly, when an application of high pressure is not required, only the first servomotor is controlled, and when an application of high pressure is required, the first servomotor and the second servomotors are controlled. The cases in which a high pressure is required include: processing large sized holes, some stages in the processing of thick workpieces, and processing thin holes, etc.

Figure 10:
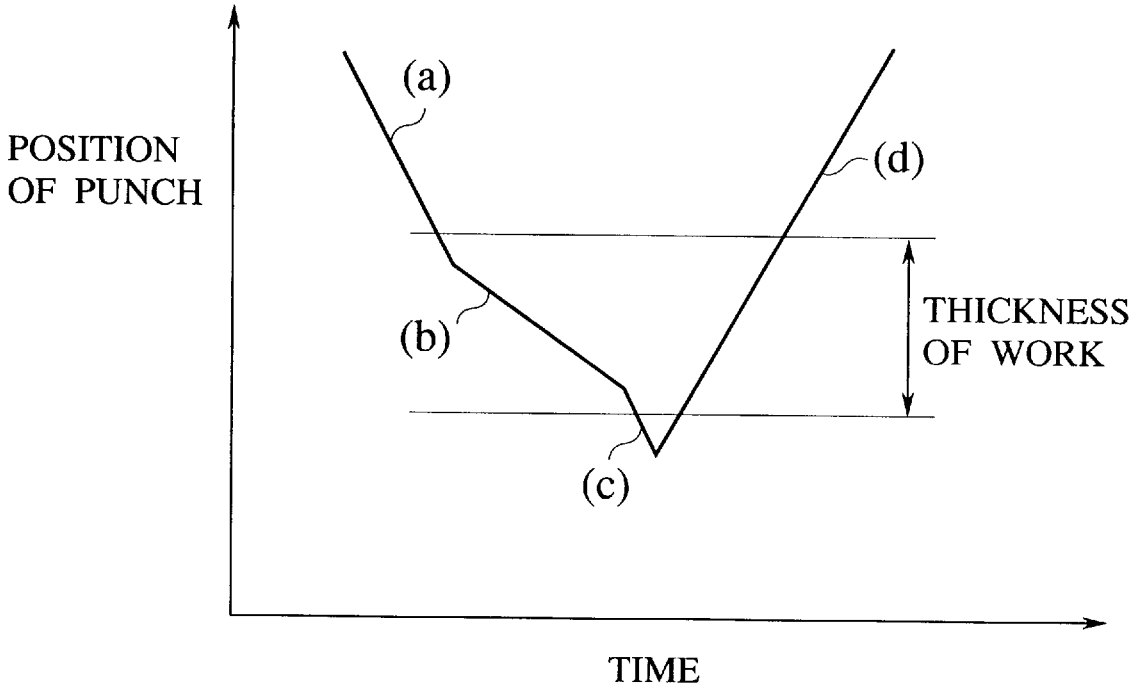
FIG. 10 shows a diagram illustrating an operation of the punch.

FIG. 10 shows a diagram illustrating an operation of the punch 7 which processes a thick workpiece. In this case, only the first servomotor is controlled at relatively high speed and low pressure in the stage that does not require an application of high pressure (a)(c)(d), and the first servomotor and the second servomotors are controlled at relatively low speed and high pressure in the stage that requires an application of high pressure (b).

As described above, in the ram driving device according to the present invention, the movement stroke and the vertical speed of the ram can be controlled freely by changing the rotational speed of a plurality of servomotors in synchronism with each other. In addition, the press power can be increased by use of an appropriate number of servomotors driven in synchronism with each other. As a result, it is possible to adopt the ram driving device according to the present invention to the press machines of various type of different ram movement strokes and ram vertical speeds.

What is claimed is:

1. A ram driving device for a press machine having a ram, said press machine for engaging plate workpieces, comprising:

a ram for engaging a tool for working a plate workpiece;

a horizontal drive axle rotatably provided horizontally in a frame of the press machine;

a motion converting mechanism associated with said horizontal drive axle and said ram, for converting a rotational motion of said horizontal drive axle into up-and-down motion of the ram;

a first servomotor always controlled to drive said horizontal drive axle; and at least one second servomotor controlled to drive said horizontal axle synchronously with said first servomotor when an application of high pressure to the tool is required.

2. The ram driving device for a press machine of claim 1, wherein said first servomotor is linked with one end of said horizontal drive axle and said second servomotor is linked with the other end of said horizontal drive axle.

3. The ram driving device for a press machine of claim 1, said second servomotor is controlled when processing a relatively thick plate workpiece.

4. The ram driving device for a press machine of claim 1, said second servomotor is controlled when processing relatively large sized holes in a plate workpiece.

5. The ram driving device for a press machine of claim 1, said second servomotor is controlled at some stage of processing a relatively thick plate workpiece.

6. The ram driving device for a press machine of claim 1, wherein the workpiece has a thickness, and wherein said second servomotor is controlled in the middle of the thickness of the plate workpiece when processing a relatively thick plate workpiece.

* * * * *